US007754671B2

(12) United States Patent
Lin et al.

(10) Patent No.: US 7,754,671 B2
(45) Date of Patent: Jul. 13, 2010

(54) LIQUID LAUNDRY DETERGENT CONTAINING AN ETHOXYLATED ANIONIC/NONIONIC SURFACTANT MIXTURE AND FABRIC CONDITIONER

(75) Inventors: Bin Lin, Phoenix, AZ (US); Michael Lewis, Glendale, AZ (US); Thorsten Bastigkeit, Scottsdale, AZ (US)

(73) Assignee: The Dial Corporation, Scottsdale, AZ (US)

( * ) Notice: Subject to any disclaimer, the term of this patent is extended or adjusted under 35 U.S.C. 154(b) by 526 days.

(21) Appl. No.: 11/792,162

(22) PCT Filed: Dec. 21, 2005

(86) PCT No.: PCT/US2005/047627

§ 371 (c)(1),
(2), (4) Date: Jun. 1, 2007

(87) PCT Pub. No.: WO2006/072083

PCT Pub. Date: Jul. 6, 2006

(65) Prior Publication Data

US 2008/0051309 A1 Feb. 28, 2008

Related U.S. Application Data

(60) Provisional application No. 60/639,397, filed on Dec. 27, 2004.

(51) Int. Cl.

| | |
|---|---|
| ***C11D 1/86*** | (2006.01) |
| ***C11D 1/62*** | (2006.01) |
| ***C11D 1/29*** | (2006.01) |
| ***C11D 1/72*** | (2006.01) |
| ***C11D 9/36*** | (2006.01) |

(52) U.S. Cl. ..... 510/340; 510/276; 510/287; 510/289; 510/290; 510/308; 510/327; 510/329; 510/351; 510/352; 510/356; 510/357; 510/421; 510/422; 510/423; 510/425; 510/427; 510/428; 510/466; 510/504

(58) Field of Classification Search ..... 510/276, 510/287, 289, 290, 308, 327, 329, 340, 351, 510/352, 356, 357, 421, 422, 423, 425, 427, 510/428, 466, 504

See application file for complete search history.

(56) References Cited

U.S. PATENT DOCUMENTS

2003/0171247 A1 * 9/2003 Meine et al. ..... 510/504

* cited by examiner

*Primary Examiner*—Charles I Boyer
(74) *Attorney, Agent, or Firm*—A. Kate Huffman; Paul A. Pappalardo

(57) ABSTRACT

This invention relates to a aqueous liquid laundry composition which both cleans and conditions fabrics. The composition includes certain alcohol ethoxylates as a nonionic surfactant component, certain alkyl ether sulfates as an anionic component and a quaternary ammonium fabric softening agent. All of the foregoing are in specified proportions.

12 Claims, No Drawings

LIQUID LAUNDRY DETERGENT CONTAINING AN ETHOXYLATED ANIONIC/NONIONIC SURFACTANT MIXTURE AND FABRIC CONDITIONER

CROSS-REFERENCE TO RELATED APPLICATION

This is the U.S. national phase application of International Application No. PCT/US2005/047627, filed Dec. 21, 2005, which claims the benefit of U.S. Provisional Application No. 60/639,397, filed Dec. 27, 2004.

FIELD OF INVENTION

This invention relates to liquid detergent compositions for laundry use and particularly to liquid detergent compositions containing ingredients to condition laundered fabrics by reducing the static buildup and soften the fabrics.

BACKGROUND OF THE INVENTION

Compositions to soften fabrics and to reduce static building up in the laundering process are well known. Since the principal ingredients in commercially available fabric softeners are usually cationic in charge and since most laundry detergent products contain anionic surfactants, one must be careful in combining the two together. Thus, the softeners are usually added to the last rinse cycle of a laundry process. This is done to avoid the interaction between the cationic softener and the anionic surfactant. More recently a popular way of conditioning fabric is to impregnate sheets with the cationic surfactant and then add such sheets to moist laundry in a laundering dryer. This avoids any interaction between the cationic surfactant and the anionic surfactant.

Numerous attempts have been made to formulate laundry detergent compositions that have good cleaning properties together with textile softening properties so as to avoid the necessity of using a separate rinse-added textile softener product in addition to the usual laundry detergent. Since cleaning by definition involves the removal of material from the textile surface and textile softening normally involves deposition of material onto the same surface, these attempts have typically required a compromise in formulation between cleaning and softening performance.

Attempts to formulate aqueous heavy duty liquid laundry detergent compositions containing anionic surfactants and a quaternary ammonium fabric-softening agent like lauryl trimethyl ammonium chloride and which provide softening through the wash and static control benefits have resulted in poor physical product characteristics including phase separation or have resulted in poor fabric cleaning performance.

SUMMARY OF THE INVENTION

The present invention encompasses substantially clear (or opaque), aqueous, liquid laundry detergent compositions that are stable at temperatures of up to about 140° F. even though some of the components are unstable at lower temperatures. These compositions also have good cleaning properties together with good fabric softening properties so that a separate rinse added or dryer added softener is not necessary. Such compositions comprise:

(a) from about 1.5% to about 8% by weight of a nonionic surfactant exemplified by alcohol ethoxylates having an alkyl chain length of from about 10 to about 18 carbon atoms, and having a degree of ethoxylation from about 4 to about 10 ethylene oxide moieties;

(b) from about 0.5% to about 5% by weight of an anionic surfactant exemplified by alkyl ether sulfates having an alkyl chain length from about 12 to about 18 carbon atoms, and having a degree of ethoxylation from about 0.5 to about 8 ethylene oxide moieties;

(c) from 0 to about 3% by weight of another anionic surfactant exemplified by alkyl benzene sulfonates having an alkyl chain length from about 8 to about 16, preferably from about 10 to about 14;

(d) from about 0.1% to about 5% of a quaternary ammonium fabric-softening agent having the general formula (I) below;

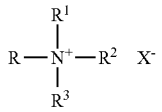

(I)

wherein, R and $R^1$ are individually selected from the group consisting of $C_1$-$C_4$ alkyl, benzyl, and —$(C_2H_4O)_nR_5$ where n has a value from 1 to 20 and $R_5$ is hydrogen or $C_1$-$C_3$ alkyl; $R^2$ and $R^3$ are each a $C_8$-$C_{30}$ alkyl or $R^2$ is a $C_8$-$C_{30}$ alkyl and $R^3$ is selected from the group consisting of $C_1$-$C_5$ alkyl, benzyl, and —$(C_2H_4O)_nH$ where n has a value from 2 to 5; and where $X^-$ represents an anion selected from the group consisting of halides, methosulfate, ethosulfate, methophosphate or phosphate ion and mixtures thereof.

(e) from 0 to about 2% by weight of a silicone copolyol carboxylate which will complex with the quaternary softening agent for enhanced performance and compatibility; and the balance including chelating agents, fluorescent whitening agents, colorants, fragrance, preservatives, rheology modifiers, opacifiers, and water.

DETAILED DESCRIPTION OF THE INVENTION

Nonionic Surfactant Component

The liquid laundry detergent composition of the present invention contains nonionic surfactants. The nonionic surfactants are particularly good at removing oily soils from fabrics. Nonionic surfactants useful in the present invention include ethoxylated and/or propoxylated, primary alcohols having 10 to 18 carbon atoms and on average from 4 to 10 mol of ethylene oxide (EO) and/or from 1 to 10 mol of propylene oxide (PO) per mole of alcohol. Further examples are alcohol ethoxylates containing linear radicals from alcohols of natural origin having 12 to 18 carbon atoms, e.g., from coconut, palm, tallow fatty or oleyl alcohol and on average from 2 to 8 EO per mole of alcohol.

In formulating the liquid detergent composition of the present invention, nonionic surfactants of the alcohol ethoxylate type are preferred since a proper HLB balance can be achieved between the hydrophobic and hydrophilic portions of the surfactant. Surprisingly it has been found that even though the preferred $C_{14}$-$C_{15}$ alcohol ethoxylate-7EO has a cloud point of about 115° F., it is stable in this detergent composition up to a temperature of about 140° F. A preferred nonionic surfactant comprising a $C_{14}$-$C_{15}$ alcohol ethoxylate-7EO is available from Shell Chemical Co. under the trademark NEODOL 45-7.

It is further possible to use alkoxylated amines as the nonionic surfactant component, ethoxylated and/or propoxylated, for example primary and secondary amines having 1 to 18 carbon atoms per alkyl chain and on average 1 to 12 mol of ethylene oxide (EO) and/or 1 to 10 mol of propylene oxide (PO) per mole of amine.

Other useful nonionic surfactants include alkylglycosides of the general formula $RO(G)_x$, where R is a primary straight-chain or methyl-branched (in the 2-position, for example) aliphatic radical having 8 to 22 carbon atoms and where G represents a glycosyl unit having 5 or 6 carbon atoms, for example glucose. The degree of oligomerization x, which indicates the distribution of monoglycosides and oligoglycosides, is any desired number between 1 and 10; preferably, x is in the range from 1.2 to 1.4.

Further useful nonionic surfactants include those known as gemini surfactants. This term is used generally to refer to those compounds that possess two hydrophilic and two hydrophobic groups per molecule. These groups are generally separated from one another by what is known as a spacer. This spacer is generally a carbon chain, which is normally long enough to keep the hydrophilic groups at a distance sufficient to allow them to act independently of one another. Surfactants of this kind are generally notable for an unusually low critical micelle concentration and the ability to markedly decrease the surface tension of water. Additionally, the term gemini surfactants is used to include not only dimeric but also trimeric surfactants.

Examples of useful gemini surfactants are sulfated hydroxy mixed ethers or dimer alcohol bis- and trimer alcohol tris-sulfates and ether sulfates. Tipped dimeric and trimeric mixed ethers are notable for their bi- and multi-functionality. These capped surfactants possess good wetting properties and are low-sudsing, making them particularly suitable for mechanical washing and cleaning processes. It is also possible to use gemini-polyhydroxy fatty acid amides or polyhydroxy fatty acid amides.

Further useful nonionic surfactants are polyhydroxy fatty acid amides of the formula;

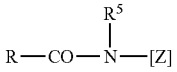

where R—CO is an aliphatic acyl radical having 6 to 22 carbon atoms, $R^5$ is hydrogen or an alkyl or hydroxyalkyl radical having 1 to 4 carbon atoms, and [Z] is a linear or branched polyhydroxyalkyl radical having 3 to 10 carbon atoms and 3 to 10 hydroxyl groups. The polyhydroxy fatty acid amides are typically obtainable by reductive amination of a reducing sugar with ammonia, an alkylamine or an alkanolamine followed by subsequent acylation with a fatty acid, a fatty acid alkyl ester or a fatty acid chloride.

The group of the polyhydroxy fatty acid amides also includes compounds of the formula;

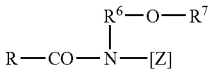

where R is a linear or branched alkyl or alkenyl radical having 7 to 12 carbon atoms, $R^6$ is a linear, branched or cyclic alkyl radical or an aryl radical having 2 to 8 carbon atoms and $R^7$ is a linear, branched or cyclic alkyl radical or an aryl radical or an oxyalkyl radical having 1 to 8 carbon atoms. For example, the substituents may include $C_{1-4}$-alkyl radicals or phenyl radicals, with [Z] being a linear polyhydroxyalkyl radical whose alkyl chain is substituted by at least two hydroxyl groups, or alkoxylated, preferably ethoxylated or propoxylated, derivatives of said radical.

Substituent [Z] may be obtained by reductive amination of a sugar such as glucose, fructose, maltose, lactose, galactose, mannose, or xylose. The N-alkoxy- or N-aryloxy-substituted compounds may then be converted to the target polyhydroxy fatty acid amides, by reaction with fatty acid methyl esters in the presence of an alkoxide as catalyst.

Amine oxides suitable according to the invention include alkylamine oxides, in particular alkyldimethylamine oxides, alkylamidoamine oxides and alkoxyalkylamine oxides. Preferred amine oxides satisfy the formulas (I) and (II);

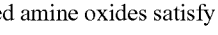

$$R^6R^7R^8N^+—O^- \quad (I)$$

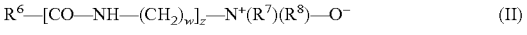

$$R^6—[CO—NH—(CH_2)_w]_z—N^+(R^7)(R^8)—O^- \quad (II)$$

in which for both (I) and (II):

$R^6$ is a saturated or unsaturated $C_{6-22}$-alkyl radical, preferably $C_{8-18}$-alkyl radical, in particular a saturated $C_{10-16}$-alkyl radical, for example a saturated $C_{12-14}$-alkyl radical, which is bonded to the nitrogen atom N in the alkylamidoamine oxides via a carbonylamidoalkylene group —CO—NH—$(CH_2)_z$, and in the alkoxyalkylamine oxides via an oxaalkylene group —O—$(CH_2)_z$, where z is in each case a number from 1 to 10, preferably 2 to 5, in particular 3, $R^7$, $R^8$ independently of one another are a $C_{1-4}$-alkyl radical, optionally hydroxy-substituted, such as e.g. a hydroxyethyl radical, in particular a methyl radical.

Examples of suitable amine oxides are the following compounds named in accordance with INCI: Almondamidopropylamine Oxide, Babassuamidopropylamine Oxide, Behenamine Oxide, Cocamidopropyl Amine Oxide, Cocamidopropylamine Oxide, Cocamine Oxide, Coco-Morpholine Oxide, Decylamine Oxide, Decyltetradecylamine Oxide, Diaminopyrimidine Oxide, Dihydroxyethyl C8-10 Alkoxypropylamine Oxide, Dihydroxyethyl C9-11 Alkoxypropylamine Oxide, Dihydroxyethyl C12-15 Alkoxypropylamine Oxide-, Dihydroxyethyl Cocamine Oxide, Dihydroxyethyl Lauramine Oxide, Dihydroxyethyl Stearamine Oxide, Dihydroxyethyl Tallowamine Oxide, Hydrogenated Palm Kernel Amine Oxide, Hydrogenated Tallowamine Oxide, Hydroxyethyl Hydroxypropyl C12-15 Alkoxypropylamine Oxide, Isostearamidopropylamine Oxide, Isostearamidopropyl Morpholine Oxide, Lauramidopropylamine Oxide, Lauramine Oxide, Methyl Morpholine Oxide, Milkamidopropyl Amine Oxide, Minkamidopropylamine Oxide, Myristamidopropylamine Oxide, Myristamine Oxide, Myristyl/Cetyl Amine Oxide, Oleamidopropylamine Oxide, Oleamine Oxide, Olivamidopropylamine Oxide, Palmitamidopropylamine Oxide, Palmitamine Oxide, PEG-3 Lauramine Oxide, Potassium Dihydroxyethyl Cocamine Oxide Phosphate, Potassium Tris phosphonomethylamine Oxide, Sesamidopropylamine Oxide, Soyamidopropylamine Oxide, Stearamidopropylamine Oxide, Stearamine Oxide, Tallowamidopropylamine Oxide, Tallowamine Oxide, Undecylenamidopropylamine Oxide and Wheat Germamidopropylamine Oxide.

The liquid laundry detergent composition in one embodiment of the present invention comprises nonionic surfactants in amounts up to about 10% by weight, preferably in the range from about 1.5% to about 8% by weight, and especially in the range of from about 2% to about 4% by weight, each percentage being based on the entire composition.

Anionic Surfactant Component

With respect to the anionic surfactants useful in this composition, the alkyl ether sulfates also known as alcohol ether sulfates are preferred. Alcohol ether sulfates are the sulfuric monoesters of the straight chain or branched C7-C21 alcohols ethoxylated with from about 0.5 to about 8 mol of ethylene oxide, such as C12-C18 alcohols containing from 0.5 to 8 EO. A preferred anionic surfactant for use in one embodiment of the present invention is C12-C18 alcohol ether sulfate with a degree of ethoxylation of from about 0.5 to about 8 ethylene oxide moieties.

Other anionic surfactants that can be used are alkyl sulfates, also known as alcohol sulfates. These surfactants have the general formula R—O—$SO_3$Na where R is from about 11 to 18 carbon atoms and may also be denoted as sulfuric monoesters of C11-C18 alcohols, examples being sodium decyl sulfate, sodium palmityl alkyl sulfate, sodium myristyl alkyl sulfate, sodium dodecyl sulfate, sodium tallow alkyl sulfate, sodium coconut alkyl sulfate, and mixtures of these surfactants, or of C10-C20 oxo alcohols, and those monoesters of secondary alcohols of this chain length. Also useful are the alk(en)yl sulfates of said chain length which contain a synthetic straight-chain alkyl radical prepared on a petrochemical basis, these sulfates possessing degradation properties similar to those of the corresponding compounds based on fatty-chemical raw materials. From a detergents standpoint, C12-C16-alkyl sulfates and C12-C15-alkyl sulfates, and also C14-C15 alkyl sulfates, are preferred. In addition, 2,3-alkyl sulfates, which may for example be obtained as commercial products from Shell Oil Company under the name DAN®, are suitable anionic surfactants.

Besides the alkyl sulfates or the alkyl ether sulfates, the present invention's liquid laundry detergent compositions may comprise further anionic surfactants.

Other anionic surfactants that are useful in this composition are the alkyl benzene sulfonates. Suitable alkyl benzene sulfonates include the sodium salts of straight or branched-chain alkyl benzene sulfonic acids. Alkyl benzene sulfonic acids useful as precursors for these surfactants include decyl benzene sulfonic acid, undecyl benzene sulfonic acid, dodecyl benzene sulfonic acid, tridecyl benzene sulfonic acid, tetrapropylene benzene sulfonic acid and mixtures thereof. Preferred sulfonic acids, functioning as precursors to the alkyl benzene sulfonates useful for compositions herein, are those in which the alkyl chain is linear and averages about 8 to 16 carbon atoms ($C_8$-$C_{16}$) in length. Examples of commercially available alkyl benzene sulfonic acids useful in the present invention include Calsoft LAS-99 marketed by the Pilot Chemical Company.

Further useful anionic surfactants include additional sulfonate type and sulfate type surfactants. Examples of useful sulfonate type surfactants are olefinsulfonates, i.e. mixtures of alkenesulfonates and hydroxyalkanesulfonates, and also disulfonates as are obtained, for example, from $C_{12-18}$-monoolefins having a terminal or internal double bond by sulfonating with gaseous sulfur trioxide followed by alkaline or acidic hydrolysis of the sulfonation products. Also suitable are alkanesulfonates, which are obtained from $C_{12-18}$-alkanes, for example by sulfochlorination or sulfoxidation with subsequent hydrolysis or neutralization, respectively. Likewise suitable, in addition, are the esters of α-sulfo fatty acids (ester sulfonates), e.g. the α-sulfonated methyl esters of hydrogenated coconut, palm kernel or tallow fatty acids.

Further suitable anionic surfactants are sulfated fatty acid glycerol esters which are the monoesters, diesters and triesters, and mixtures thereof, as obtained in the preparation by esterification of a monoglycerol with from 1 to 3 mol of fatty acid or in the transesterification of triglycerides with from 0.3 to 2 mol of glycerol. Preferred sulfated fatty acid glyceryl esters are sulfation products of saturated fatty acids of 6 to 22 carbon atoms, e.g., of capric acid, caprylic acid, capric acid, myristic acid, lauric acid, palmitic acid, stearic acid or behenic acid.

Further anionic surfactants for use in the present invention also include the salts of alkylsulfosuccinic acid, which are also referred to as sulfosuccinates or as sulfosuccinic esters and which constitute the monoesters and/or diesters of sulfosuccinic acid with alcohols, for example fatty alcohols and ethoxylated fatty alcohols. Exemplary sulfosuccinates comprise $C_{8-18}$ fatty alcohol radicals or mixtures thereof. Exemplary sulfosuccinates contain a fatty alcohol radical derived from ethoxylated fatty alcohols which themselves represent nonionic surfactants. Of use in the present invention are the sulfosuccinates whose fatty alcohol radicals are derived from ethoxylated fatty alcohols having a narrowed homolog distribution. Similarly, it is also possible to use alk(en)ylsuccinic acid containing 8 to 18 carbon atoms in the alk(en)yl chain, or salts thereof.

Further suitable anionic surfactants are conventional soaps. Suitable soaps include saturated fatty acid soaps, such as the salts of lauric acid, myristic acid, palmitic acid, stearic acid, hydrogenated erucic acid and behenic acid, and mixtures of soaps derived from natural fatty acids, e.g., coconut, palm kernel, or tallow fatty acids. The anionic surfactants, including the soaps, may be present in the form of their sodium, potassium or ammonium salts and also as soluble salts of organic bases, such as mono-, di- or triethanolamine.

A further class of anionic surfactants is the class of ether carboxylic acids that are obtainable by reacting fatty alcohol ethoxylates with sodium chloroacetate in the presence of basic catalysts. Ether carboxylic acids have the general formula: $R^{10}O—(CH_2—CH_2—O)_p—CH_2—COOH$ where $R^{10}$=$C_1$-$C_{18}$ and p=0.1 to 20. Ether carboxylic acids are water hardness insensitive and have excellent surfactant properties.

The liquid laundry detergent compositions of the present invention in a preferred embodiment comprise these further anionic surfactants in amounts that preferably do not exceed 3% by weight.

The Quaternary Softener Component

Examples of cationic fabric-softening components useful in the present invention are quaternary ammonium compounds.

Suitable examples are quaternary ammonium compounds of the formulae (I) and (II)

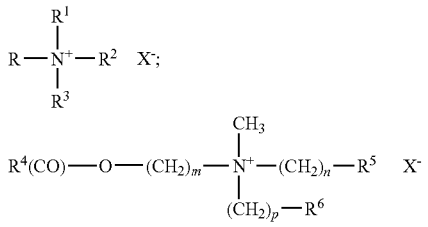

(I)

wherein R and $R^1$ are individually selected from the group consisting of $C_1$-$C_4$ alkyl, benzyl, and —$(C_2H_4O)_xR_5$ where x has a value from 1 to 20 and $R_5$ is hydrogen or $C_1$-$C_3$ alkyl; $R^2$ and $R^3$ are each a $C_8$-$C_{30}$ alkyl or $R^2$ is a $C_8$-$C_{30}$ alkyl and $R^3$ is selected from the group consisting of $C_1$-$C_5$ alkyl, benzyl, and —$(C_2H_4O)_xH$ where x has a value from 2 to 5; and where $X^-$ represents an anion selected from the group consisting of halides, methosulfate, ethosulfate, methophosphate or phosphate ion and mixtures thereof. Examples of cationic compounds of the formula (I) are didecyldimethylammonium chloride, ditallowdimethylammonium chloride or dihexadecylammonium chloride.

Additionally, a preferred cationic softening agent for use in the present invention has the structure;

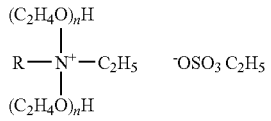

wherein R is an alkyl chain having from about 8 to about 30 carbon atoms and n is from about 1 to about 20.

Compounds of the formula (II) are known as ester quats. Ester quats are notable for excellent biodegradability. In the formula (II), $R^4$ represents an aliphatic alkyl radical of 12 to 22 carbon atoms which has 0, 1, 2 or 3 double bonds; $R^5$ represents H, OH or $O(CO)R^7$, $R^6$ represents H, OH or $O(CO)R^8$ independently of $R^5$, with $R^7$ and $R^8$ each being independently an aliphatic alkyl radical of 12 to 22 carbon atoms which has 0, 1, 2 or 3 double bonds. m, n and p are each independently 1, 2 or 3. $X^-$ may be a halide, methosulfate, ethosulfate, methophosphate or phosphate ion and also mixtures thereof. Useful are compounds where $R^5$ is $O(CO)R^7$ and $R^4$ and $R^7$ are alkyl radicals having 16 to 18 carbon atoms, particularly compounds wherein $R^6$ also represents OH. Examples of compounds of the formula (II) are methyl-N-(2-hydroxyethyl)-N,N-di-(tallowacyloxyethyl)ammonium methosulfate, bis-(palmitoyl) ethylhydroxyethylmethylammonium methosulfate or methyl-N,N-bis(acyloxyethyl)-N-(2-hydroxyethyl) ammonium methosulfate. In quaternized compounds of the formula (II) which comprise unsaturated alkyl chains, preference is given to acyl groups whose corresponding fatty acids have an iodine number between 5 and 80, preferably between 10 and 60 and especially between 15 and 45 and also a cis/trans isomer ratio (in % by weight) of greater than 30:70, preferably greater than 50:50 and especially greater than 70:30. Commercially available examples are the methylhydroxyalkyldialkoyloxyalkylammonium methosulfates marketed by Stepan under the Stepantex® brand or the Cognis products appearing under Dehyquart® or the Goldschmidt-Witco products appearing under Rewoquat®.

Further ester quats of use in the present invention have the formulas;

$[(CH_3)_2N^+(CH_2CH_2OC(O)—R)_2]\ X^-$ or $[(HOCH_2CH_2)(CH_3)N^+(CH_2CH_2OC(O)—R)_2]\ X^-$ where R=linear saturated or unsaturated alkyl radical of 11 to 19 and preferably 13 to 17 carbon atoms. In a particularly preferred embodiment the fatty acid residues are tallow fatty acid residues. $X^-$ represents either a halide, for example chloride or bromide, methophosphate, ethophosphate, methosulfate, ethosulfate, and also mixtures thereof.

In addition to the quaternary ammonium compounds of the formulae (I) and (II) it is also possible to use short-chain, water-soluble quaternary ammonium compounds, such as trihydroxyethylmethylammonium methosulfate or alkyltrimethylammonium chlorides, dialkyldimethylammonium chlorides and trialkylmethylammonium chlorides, for example cetyltrimethylammonium chloride, stearyltrimethylammonium chloride, distearyldimethylammonium chloride, lauryldimethylammonium chloride, lauryldimethylbenzylammonium chloride and tricetylmethylammonium chloride.

Further useful quaternary ammonium fabric-softening agents include the diester quats of the formula (III), obtainable under the name Rewoquat® W 222 LM or CR 3099, which provide stability and color protection as well as softness.

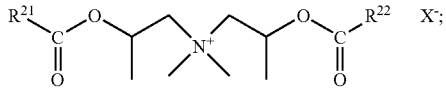

(III)

where $R^{21}$ and $R^{22}$ each independently represent an aliphatic radical of 12 to 22 carbon atoms which has 0, 1, 2 or 3 double bonds.

As well as the quaternary compounds described above it is also possible to use other known compounds, for example quaternary imidazolinium compounds of the formula (IV)

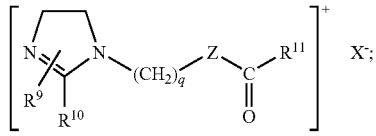

(IV)

where $R^9$ represents H or a saturated alkyl radical having 1 to 4 carbon atoms, $R^{10}$ and $R^{11}$ are each independently an aliphatic, saturated or unsaturated alkyl radical having 12 to 18 carbon atoms, $R^{10}$ may alternatively also represent $O(CO)R^{20}$, $R^{20}$ being an aliphatic, saturated or unsaturated alkyl radical of 12 to 18 carbon atoms, Z is an NH group or oxygen, $X^-$ is an anion and q can assume integral values between 1 and 4.

Useful quaternary compounds are further described by the formula (V)

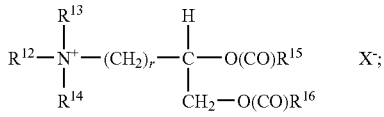

(V)

where $R^{12}$, $R^{13}$ and $R^{14}$ independently represent a $C_{1-4}$-alkyl, alkenyl or hydroxyalkyl group, $R^{15}$ and $R^{16}$ each independently represent a $C_{8-28}$-alkyl group and r is a number between 0 and 5.

Suitable fabric softening compositions are cationic polymers that include the polyquatemium polymers, as in the CTFA Cosmetic Ingredient Dictionary (The Cosmetic, Toiletry and Fragrance, Inc. 1997), in particular the polyquaternium-6, polyquaternium-7, polyquaternium-10 polymers (Ucare Polymer IR 400; Amerchol), also referred to as merquats, polyquatemium-4 copolymers, such as graft copolymers with a cellulose backbone and quaternary ammonium groups which are bonded via allyldimethylammonium chloride, cationic cellulose derivatives, such as cationic guar, such as guar hydroxypropyltriammonium chloride, and similar quaternized guar derivatives (e.g. Cosmedia Guar, manufacturer: Cognis GmbH), cationic quaternary sugar derivatives (cationic alkyl polyglucosides), e.g. the commercial product Glucquat® 100, according to CTFA nomenclature a "Lauryl Methyl Gluceth-10 Hydroxypropyl Dimonium Chloride", copolymers of PVP and dimethylaminomethacrylate, copolymers of vinylimidazole and vinylpyrrolidone, aminosilicone polymers and copolymers.

It is likewise possible to use polyquaternized polymers (e.g. Luviquat Care from BASF) and also cationic biopolymers based on chitin and derivatives thereof, for example the polymer obtainable under the trade name Chitosan® (manufacturer: Cognis).

Specifically, N-methyl-N-(2-hydroxyethyl)-N,N-(ditallowacyloxyethyl)ammonium methosulfate or N-methyl-N-(2-hydroxyethyl)-N,N-(dipalmitoylethyl)ammonium methosulfate are useful quaternary ammonium compounds in the present invention.

Likewise suitable according to the invention are cationic silicone oils, such as, for example, the commercially available products Q2-7224 (manufacturer: Dow Coming; a stabilized trimethylsilylamodimethicone), Dow Coming 929 emulsion (comprising a hydroxyl-amino-modified silicone, which is also referred to as amodimethicone), SM-2059 (manufacturer: General Electric), SLM-55067 (manufacturer: Wacker) Abil®-Quat 3270 and 3272 (manufacturer: Goldschmidt-Rewo; diquatemary polydimethylsiloxanes, quaternium-80) and Siliconquat Rewoquat® SQ 1 (Tegopren® 6922, manufacturer: Goldschmidt-Rewo).

It is likewise possible to use compounds of the formula (VI)

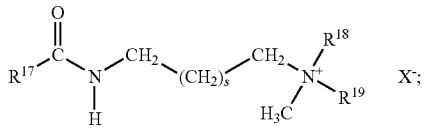

(VI)

that may comprise alkylamidoamines in their nonquaternized or, as shown, their quaternized form. $R^{17}$ may be an aliphatic alkyl radical having 12 to 22 carbon atoms with 0, 1, 2 or 3 double bonds. s can assume values between 0 and 5. $R^{18}$ and $R^{19}$ are, independently of one another, each H, $C_{1-4}$-alkyl or hydroxyalkyl. Preferred compounds are fatty acid amidoamines, such as the stearylamidopropyldimethylamine obtainable under the name Tego Amid® S18, or the 3-tallowamidopropyltrimethylammonium methosulfate obtainable under the name Stepantex® X 9124, which are characterized not only by a good conditioning effect, but also by color-transfer-inhibiting effect and in particular by their good biodegradability. Particular preference is given to alkylated quaternary ammonium compounds in which at least one alkyl chain is interrupted by an ester group and/or amido group, in particular N-methyl-N-(2-hydroxyethyl)-N,N-(ditallowacyloxyethyl)ammonium methosulfate and/or N-methyl-N-(2-hydroxyethyl)-N,N-(palmitoyloxyethyl)ammonium methosulfate.

Of fabric softeners that can be employed we in particular prefer the quaternary fatty amine ethoxylates of the formula

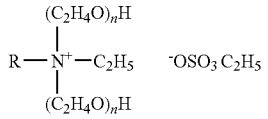

wherein R is an alky chain with 9-30 carbon atoms and n is from 1-20. Such a softener is Adogen 66 marketed by Degussa.

In a preferred embodiment, the liquid laundry detergent compositions of the present invention comprise cationic fabric-softening component in an amount up to 5% by weight, preferably in the range from 0.1% to 3% by weight, more preferably in the range from 0.5% to 2% by weight, each percentage being based on the entire composition.

Builders, Silicones, Solvents, Preservatives, and Other Ingredients

The compositions of the present invention may additionally comprise builders. Any builder customarily used in washing and cleaning compositions can be incorporated in the compositions of the present invention, including zeolites, silicates, carbonates, organic co-builders and phosphates. Some of these ingredients are known to provide the dual role of builder and chelant.

Useful crystalline, sheet-shaped sodium silicates have the general formula $NaMSi_xO_{2x+1}.H_2O$, where M is sodium or hydrogen, x is from 1.9 to 4, y is from 0 to 20 and x is preferably 2, 3 or 4. Such crystalline sheet silicates. Preferred crystalline sheet silicates of the stated formula are those in which M is sodium and x is 2 or 3. In particular, not only β- but also δ-sodium disilicates $Na_2Si_2O_5.yH_2O$ are preferred.

It is also possible to use amorphous sodium silicates having an $Na_2O:SiO_2$ modulus of from 1:2 to 1:3.3, preferably from 1:2 to 1:2.8 and in particular from 1:2 to 1:2.6, which are dissolution-delayed and have secondary washing properties. The dissolution delay relative to conventional amorphous sodium silicates may have been brought about in a variety of ways, for example by surface treatment, compounding, compacting or by over-drying. For the purposes of this invention the term "amorphous" is understood as including "X-ray-amorphous". This means that, in X-ray diffraction experiments, the silicates do not yield the sharp X-ray reflections typical of crystalline substances but instead yield at best one or more maxima of the scattered X-radiation, having a width of several degree units of the diffraction angle. However, even particularly good builder properties may result if the silicate particles in electron diffraction experiments yield vague or even sharp diffraction maxima. This is to be interpreted such that the products have microcrystalline regions with a size of from 10 to several hundred nm, values up to a maximum of 50 nm and in particular up to a maximum of 20 nm being preferred. Such so-called X-ray amorphous silicates likewise have delayed dissolution compared with conventional water glasses. Particular preference is given to compacted amorphous silicates, compounded amorphous silicates and over-dried X-ray amorphous silicates.

The finely crystalline synthetic zeolite is zeolite A and/or P. Zeolite P is preferably Zeolite MAP® (commercial product from Crosfield). Also suitable, however, are zeolite X, and mixtures of A, X and/or P. A co-crystallizate of zeolite X and zeolite A (about 80% by weight of zeolite X), which is sold by CONDEA Augusta S.p.A. under the trade name VEGOBOND AX® and can be described by the formula $$nNa_2O.(1-n)K_2O.Al_2O_3.(2\text{-}2,5)SiO_2.(3,5\text{-}5,5)\ H_2O$$
$$n=0,90\text{-}1,0$$

is, for example, also commercially available and preferred for the purposes of the present invention. Useful zeolites have an average particle size of less than 10 μm (volume distribution; method of measurement: Coulter Counter) and have a bound-water content which is preferably in the range from 18% to 22% by weight and especially in the range from 20% to 22% by weight. The zeolites can also be used as over-dried zeolites having lower water contents and then are by virtue of their hygroscopicity useful to remove unwanted trace residues of free water.

Phosphates can likewise be used as builders. Useful phosphates include the sodium and potassium salts of the orthophosphates, pyrophosphates and tripolyphosphates.

Organic builder substances useful as cobuilders and obviously also as viscosity regulators include for example the polycarboxylic acids which can be used in the form of their sodium salts, polycarboxylic acids referring to carboxylic acids having more than one acid function. Examples thereof are citric acid, adipic acid, succinic acid, glutaric acid, malic acid, tartaric acid, maleic acid, fumaric acid, sugar acids, amino carboxylic acids, nitrilotriacetic acid (NTA) and derivatives thereof and also mixtures of these. Preferred salts are the salts of polycarboxylic acids such as citric acid, adipic acid, succinic acid, glutaric acid, tartaric acid, sugar acids and mixtures of these.

Acids may also find use in the present invention. As well as their builder action, the acids typically also have the property of an acidifying component and thus also serve to impart a lower and milder pH to washing or cleaning compositions. Particularly used for this are citric acid, succinic acid, glutaric acid, adipic acid, gluconic acid and any desired mixtures of these. Useful acidifying agents further include known pH regulators such as sodium bicarbonate and sodium hydrogensulfate.

Useful builders further include polymeric polycarboxylates, i.e., for example the alkali metal salts of polyacrylic acid or of polymethacrylic acid, for example those having a relative molecular mass in the range from 500 to 70 000 g/mol.

The molar masses reported herein for polymeric polycarboxylates are weight average molar masses $M_w$ of the respective acid form, determined in principle by means of gel permeation chromatography (GPC) using a UV detector. The measurement was made against an external polyacrylic acid standard which, owing to its structural similarity to the polymers under investigation, provides realistic molecular weight values. These figures differ considerably from the molecular weight values obtained using polystyrenesulfonic acids as a standard. The molar masses measured against polystyrenesulfonic acids are generally distinctly higher than the molar masses reported herein.

Useful polymers are polyacrylates having a molecular mass in the range from 2000 to 20 000 g/mol. Owing to their superior solubility, preference in this group may be given in turn to the short-chain polyacrylates which have molar masses in the range from 2000 to 10 000 g/mol and more preferably in the range from 3000 to 5000 g/mol.

Useful polymers may further include substances that partly or wholly consist of units of vinyl alcohol or its derivatives.

Useful polymeric polycarboxylates further include copolymeric polycarboxylates, for example those of acrylic acid with methacrylic acid and of acrylic acid or methacrylic acid with maleic acid. Useful are copolymers of acrylic acid with maleic acid that comprise from 50% to 90% by weight of acrylic acid and from 50% to 10% by weight of maleic acid. Their relative molecular mass based on free acids is generally in the range from 2000 to 70 000 g/mol, preferably in the range from 20 000 to 50 000 g/mol and especially in the range from 30 000 to 40 000 g/mol. Co-polymeric polycarboxylates can be used either as an aqueuous solution or as a powder.

To improve solubility in water, polymers may further comprise allylsulfonic acids, such as allyloxybenzenesulfonic acid and methallylsulfonic acid, as a monomer.

Biodegradable polymers composed of more than two different monomer units, for example those which comprise salts of acrylic acid and of maleic acid and also vinyl alcohol or vinyl alcohol derivatives as monomers or comprise salts of acrylic acid and of 2-alkylallylsulfonic acid and also sugar derivatives as monomers may find use in the present invention.

Exemplary co-polymers further include those that comprise acrolein and acrylic acid/acrylic acid salts or acrolein and vinyl acetate as monomers.

Additional builder substances further include polymeric amino dicarboxylic acids, their salts or their precursor substances. Particular preference is given to polyaspartic acids or salts and derivatives thereof, of which it is known that they have a bleach-stabilizing effect as well as cobuilder properties. It is further possible to use polyvinylpyrrolidones, polyamine derivatives such as quaternized and/or ethoxylated hexamethylenediamines.

Useful builder substances further include polyacetals that can be obtained by reacting dialdehydes with polycarboxylic acids having 5 to 7 carbon atoms and 3 or more hydroxyl groups. Preferred polyacetals are obtained from dialdehydes such as glyoxal, glutaraldehyde, terephthalaldehyde and mixtures thereof and from polycarboxylic acids such as gluconic acid and/or glucoheptonic acid.

The compositions of the present invention may comprise builders in amounts of from 1% to 30% by weight.

Furthermore, the present invention's liquid laundry detergent compositions may additionally comprise enzymes. Enzymes augment wash processes in various ways, especially in relation to the removal of difficult-to-bleach soils, such as protein stains.

Useful enzymes include in particular those from the class of the hydrolases such as the proteases, esterases, lipases or lipolytically acting enzymes, amylases, cellulases or other glycosyl hydrolases, hemicellulases, cutinases, β-glucanases, oxidases, peroxidases, perhydrolases or laccases and mixtures thereof. All these hydrolases contribute in the wash to the removal of stains such as proteinaceous, greasy or starchy stains and grayness. Cellulases and other glycosyl hydrolases may in addition, through the removal of pilling and microfibrils, contribute to textile color preservation and softness enhancement. Similarly, oxyreductases can be used for bleaching or for inhibiting dye transfer. Enzymatic actives obtained from bacterial strains or fungi such as *Bacillus subtilis, Bacillus licheniformis, Streptomyceus griseus* and *Humicola insolens* are particularly useful. Preference is given to proteases of the subtilisin type and especially proteases obtained from *Bacillus lentus*. Enzyme mixtures, for example of protease and amylase or of protease and lipase or lipolytically acting enzymes or of protease and cellulase or of cellulase and lipase or lipolytically acting enzymes or of protease, amylase and lipase or of lipolytically acting enzymes or protease, lipase or lipolytically acting enzymes and cellulase, but especially protease and/or lipase-containing mixtures or mixtures with lipolytically acting enzymes are of particular interest. The familiar cutinases are examples of such lipolytically acting enzymes. Similarly, peroxidases or oxidases will be found useful in some cases. Useful amylases include especially α-amylases, isoamylases, pullulanases and pectinases. Cellulases used are preferably cellobiohydrolases, endoglucanases and β-glucosidases, also known as cellobiases, and mixtures thereof. Since the various cellulase types differ in CMCase and Avicelase activity, desired activities can be achieved through specific mixtures of the cellulases.

The amount of enzyme(s), liquid enzyme preparation(s) or enzyme granule(s) may range from 0.01% to 5% by weight, preferably from 0.12% to 2.5% by weight, each percentage being based on the entire composition.

In addition to water, the liquid laundry detergent composition of the present invention may comprise one or more other solvents. Solvents useful in the compositions of the present invention belong for example to the group of mono- or polyhydric alcohols, alkanolamines or glycol ethers provided they are miscible with water in the stated concentration range. Exemplary solvents may comprise ethanol, n-propanol, i-propanol, butanols, glycol, propanediol, butanediol, glycerol, diglycol, propyldiglycol, butyldiglycol, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl ether, propylene glycol ethyl ether, propylene glycol propyl ether, butoxypropoxypropanol (BPP), dipropylene glycol monomethyl ether, dipropylene glycol monoethyl ether, diisopropylene glycol monomethyl ether, diosopropylene glycol monoethyl ether, methoxytriglycol, ethoxytriglycol, butoxytriglycol, 1-butoxy-ethoxy-2-propanol, 3-methyl-3-methoxybutanol, propylene glycol t-butyl ether and also mixtures thereof.

Some glycol ethers are available under the trade names Arcosolv® (Arco Chemical Co.) or Cellosolv®, Carbitol® or Propasol® (Union Carbide Corp.); these also include for example ButylCarbitol®, HexylCarbitol®, MethylCarbitol® and Carbitol® itself, (2-(2-ethoxy)ethoxy)ethanol. The choice of glycol ether can be readily made by one skilled in the art on the basis of its volatility, water-solubility, weight percentage of the total composition and the like. Pyrrolidone solvents, such as N-alkylpyrrolidones, for example N-methyl-2-pyrrolidone or N—$C_8$-$C_{12}$-alkylpyrrolidone, or 2-pyrrolidone, can likewise be used.

Alcohols that can be employed as co-solvents in the present invention include liquid polyethylene glycols having a comparatively low molecular weight, for example polyethylene glycols having a molecular weight of 200, 300, 400 or 600. Useful co-solvents further include other alcohols, for example (a) lower alcohols such as ethanol, propanol, isopropanol and n-butanol, (b) ketones such as acetone and methyl ethyl ketone, (c) $C_2$-$C_4$-polyols such as a diol or a triol, for example ethylene glycol, propylene glycol, glycerol or mixtures thereof. 1,2-Octanediol is an exemplary diol.

The compositions of the present invention may comprise one or more water-soluble organic solvents in a preferred embodiment. Water-soluble is here to be understood as meaning that an organic solvent referred to is soluble in an aqueous composition in the amount in which it is included therein.

Furthermore, the present invention's liquid laundry detergent compositions may further comprise thickeners. The use of thickeners in particular in gel-like liquid laundry detergent compositions will boost consumer acceptance. The thickened consistency of the composition simplifies the application of the compositions directly to the stains to be treated.

Polymers originating in nature which are used as thickeners are, for example, agar-agar, carrageen, tragacanth, gum arabic, alginates, pectins, polyoses, guar flour, carob seed flour, starch, dextrins, gelatins and casein.

Modified natural substances originate primarily from the group of modified starches and celluloses, examples which may be mentioned here being carboxymethylcellulose and cellulose ethers, hydroxyethylcellulose and hydroxypropylcellulose, and carob flour ether.

A large group of thickeners which is used widely in very diverse fields of application are the completely synthetic polymers, such as polyacrylic and polymethacrylic compounds, vinyl polymers, polycarboxylic acids, polyethers, polyimines, polyamides and polyurethanes.

Thickeners from said classes of substance are commercially widely available and are offered, for example, under the trade names Acusol®-820 (methacrylic acid (stearyl alcohol-20-EO) ester-acrylic acid copolymer, 30% strength in water, Rohm & Haas), Polygel®, such as Polygel DA (3V Sigma), Carbopol®(B.F. Goodrich), such as Carbopol 940 (molecular weight approximately 4.000.000), Carbopol 941 (molecular weight approximately. 1.250.000), Carbopol 934 (molecular weight approximately 3.000.000), Carbopol ETD 2623, Carbopol 1382 (INCI Acrylates/C10-30 Alkyl Acrylate Crosspolymer) and Carbopol Aqua 30, Aculyn® and Acusol® (Rohm & Haas), Tego® Degussa-Goldschmidt), Dapral®-GT-282-S (alkyl polyglycol ether, Akzo), Deuterol®-Polymer-11 (dicarboxylic acid copolymer, Schöner GmbH), Deuteron®-XG (anionic heteropolysaccharide based on β-D-glucose, D-mannose, D-glucuronic acid, Schöner GmbH), Deuteron®-XN (nonionogenic polysaccharide, Schöner GmbH), Dicrylan®-Verdicker-O (ethylene oxide adduct, 50% strength in water/isopropanol, Pferse Chemie), EMA®-81 and EMA®-91 (ethylene-maleic anhydride copolymer, Monsanto), Verdicker-QR-1001 (polyurethane emulsion, 19-21% strength in water/diglycol ether, Rohm & Haas), Mirox®-AM (anionic acrylic acid-acrylic ester copolymer dispersion, 25% strength in water, Stockhausen), SER-AD-FX-1100 (hydrophobic urethane polymer, Servo Delden), Shellflo®-S (high molecular weight polysaccharide, stabilized with formaldehyde, Shell), and Shellflo®-XA (xanthan biopolymer, stabilized with formaldehyde, Shell).

An exemplary polymeric polysaccharide thickener is xanthan, a microbial anionic heteropolysaccharide produced by Xanthomonas campestris and other species under aerobic conditions and has a molar mass in the range from 2 to 15 million g/mol. Xanthan is formed from a chain of β-1,4-bound glucose (cellulose) having side chains. The structure of the subgroups consists of glucose, mannose, glucuronic acid, acetate and pyruvate, the number of pyruvate units determining the viscosity of the xanthan.

In an embodiment of the present invention, the liquid laundry detergent composition comprises thickeners in amounts up to 10% by weight, more preferably up to 5% by weight and especially in the range from 0.1% to 1% by weight, each based on the entire composition.

The compositions of the present invention may comprise bleaches.

Among compounds that serve as bleaches in that they liberate $H_2O_2$ in water, sodium percarbonate, sodium perborate tetrahydrate and sodium perborate monohydrate. Useful bleaches further include for example peroxypyrophosphates, citrate perhydrates and also $H_2O_2$-supplying peracidic salts or peracids, such persulfates and persulfuric acid. It is also possible to use urea peroxohydrate, i.e., percarbamide, which is described by the formula $H_2N—CO—NH_2.H_2O_2$. Especially when the compositions are used for cleaning hard surfaces, for example in dishwashers, they can if desired also include bleaches from the group of organic bleaches, although their use is in principle also possible in textile-washing compositions. Typical organic bleaches include diacyl peroxides, for example dibenzoyl peroxide. Typical organic bleaches further include peroxyacids, examples being in particular alkylperoxyacids and arylperoxy-acids. Exemplary representatives are peroxybenzoic acid and its ring-substituted derivatives, such as alkylperoxybenzoic acids, but also peroxy-α-naphthoic acid and magnesium monoperphthalate, aliphatic or substitutedly aliphatic peroxyacids, such as peroxylauric acid, peroxystearic acid, ε-phthalimidoperoxycaproic acid (phthalimidoperoxyhexanoic acid, PAP), o-carboxybenzamidoperoxycaproic acid, N-nonenylamidoperadipic acid and N-nonenylamidopersuccinates, and alipahtic and araliphatic peroxydicarboxylic acids, such as 1,12-diperoxy carboxylic acid, 1,9-diperoxyazelaic acid, diperoxysebacic acid, diperoxybrassylic acid, diperoxyphthalic acids, 2-decyldiperoxybutane-1,4-diacid, N,N-terephthaloyldi(6-aminopercaproic acid).

The compositions of the present invention may comprise bleach activators.

Compounds used as bleach activators produce aliphatic peroxo carboxylic acids having preferably 1 to 10 carbon atoms and especially 2 to 4 carbon atoms and/or as the case may be substituted perbenzoic acid under perhydrolysis conditions. Substances that bear O- and/or N-acyl groups of the stated number of carbon atoms and/or substituted or unsubstituted benzoyl groups are suitable. Exemplary are multiply acylated alkylenediamines, such as tetraacetylethylenediamine (TAED), acylated triazine derivatives, especially 1,5-diacetyl-2,4-dioxohexahydro-1,3,5-tri-azine (DADHT), acylated glycolurils, etetra-acetylglycoluril (TAGU), N-acylimides, N-nonanoylsuccinimide (NOSI), acylated phenolsulfonates, especially n-nonanoyl- or isononanoyloxybenzenesulfonate (n- and iso-NOBS respectively), carboxylic anhydrides, phthalic anhydride, acylated polyhydric alcohols, triacetin, triethyl acetylcitrate (TEAC), ethylene glycol diacetate, 2,5-diacetoxy-2,5-dihydrofuran and the enol esters and also acetylated sorbitol and mannitol, acylated sugar derivatives, especially pentaacetylglucose (PAG), pentaacetylfructose, tetraacetylxylose and octaacetyllactose and also acylated, optionally N-alkylated glucamine and gluconolactone, and/or N-acylated lactams, for example N-benzoylcaprolactam. The hydrophilically substituted aceylacetals and the acyllactams are likewise useful. Similarly, the combinations of conventional bleach activators can likewise be used.

Furthermore, the present invention's liquid laundry detergent compositions may additionally comprise complexing agents in a preferred embodiment. Complexing agents improve the stability of the compositions and protect for example against heavy metal catalyzed decomposition of certain ingredients of detersive formulations.

The group of complexing agents includes for example the alkali metal salts of nitrilotriacetic acid (NTA) and its derivatives and also alkali metal salts of anionic polyelectrolytes such as polyacrylates, polymaleates and polysulfonates and the various salts of ethylenediaminetetraacetic acid (EDTA). Of use in the present invention is tetrasodium ethylenediaminetetracetate ($Na_4$-EDTA). Useful complexing agents further include low molecular weight hydroxy carboxylic acids such as citric acid, tartaric acid, malic acid or gluconic acid and their salts. These preferred compounds include in particular organophosphonates such as for example 1-hydroxyethane-1,1-diphosphonic acid (HEDP), aminotri(methylenephosphonic acid) (ATMP), diethylenetriaminepenta(methylenephosphonic acid) (DTPMP or DETPMP) and also 2-phosphonobutane-1,2,4-tricarboxylic acid (PBS-AM), which are usually used in the form of their ammonium or alkali metal salts.

In a preferred embodiment of the present invention's liquid laundry detergent compositions the complexing agents are present in an amount up to 10% by weight, preferably from 0.01% to 5% by weight, more preferably from 0.1% to 2% by weight and especially from 0.3% to 1.0% by weight, each percentage being based on the entire composition.

The compositions of the present invention may comprise electrolytes.

A large number of various salts can be used as electrolytes from the group of the inorganic salts. Exemplary cations are the alkali and alkaline earth metals and exemplary anions are the halides and sulfates. From the point of view of manufacturing convenience, the use of NaCl or $MgCl_2$ in the compositions of the present invention is preferred. The fraction of electrolytes in the compositions of the present invention is typically in the range from 0.5% to 5% by weight.

The compositions of the present invention may comprise pH standardizers.

To adjust the pH of the compositions according to the invention into the desired range, the use of pH standardizers may be indicated. Useful pH standardizers include all known acids and alkalis unless their use is ruled out by performance or ecological concerns or by consumer protection concerns. Typically, the amount of these standardizers does not exceed 2% by weight of the total formulation.

The compositions of the present invention may comprise dyes and fragrances.

Dyes and fragrances are added to the compositions of the invention in order to enhance the esthetic appeal of the products and to provide the consumer with not only the washing or cleaning performance but also a visually and sensorially "typical and unmistakable" product. As perfume oils and/or fragrances it is possible to use individual odorant compounds, examples being the synthetic products of the ester, ether, aldehyde, ketone, alcohol and hydrocarbon types. It is possible to use mixtures of different odorants, which together produce an appealing fragrance note. Such perfume oils may also contain natural odorant mixtures, as are obtainable from plant sources.

The compositions of the present invention may additionally comprise optical brighteners.

Optical brighteners (so-called "whitening agents" or "fluorescent whiteners") can be added to the products according to the invention in order to eliminate graying and yellowing of the treated textiles. These substances attach to the fibers and bring about a brightening and simulated bleaching action by converting invisible ultraviolet radiation into visible longer-wave length light, the ultraviolet light absorbed from sunlight being irradiated as a pale bluish fluorescence and, together with the yellow shade of the grayed or yellowed laundry, producing pure white. Suitable compounds originate, for example, from the classes of substance of 4,4'-diamino-2,2'-stilbenedisulfonic acids (flavonic acids), 4,4'-distyrylbiphenyls, methylumbelliferones, coumarins, dihydroquinolinones, 1,3-diarylpyrazolines, naphthalimides, benzoxazol, benzisoxazol and benzimidazol systems, and pyrene derivatives substituted by heterocycles. The optical brighteners are usually used in amounts between 0.005% and 0.3% by weight, based on the finished product.

The compositions of the present invention may comprise UV absorbers.

The compositions may comprise UV absorbers which go onto the treated textiles and improve the light stability of the fibers and/or the light stability of the other formula components. UV absorbers should be understood to mean organic substances (light filters) which are capable of absorbing ultraviolet rays and reemitting the absorbed energy in the form of longer-wave radiation, e.g. heat. Examples of compounds which have these desired properties are the compounds active through non-radiative deactivation and derivatives of benzophenone with substituents in the 2- and/or 4-position. Further, substituted benzotriazoles, such as for example the water-soluble benzenesulfonic acid-3-(2H-benzotriazol-2-yl)-4-hydroxy-5-(methylpropyl)-monosodium salt (Cibafast® H), acrylates phenyl-substituted in the 3-position (cinnamic acid derivatives), optionally with cyano groups in the 2-position, salicylates, organic Ni complexes and natural substances such as umbelliferone and the endogenous urocanic acid are suitable. Of particular importance are biphenyl-derivatives and, above all, stilbene derivatives and are commercially available from Ciba as Tinosorb® FD or Tinosorb® FR. As UV-B absorbers, mention can be made of 3-benzylidenecamphor and 3-benzylidene-norcamphor and derivatives thereof, e.g. 3-(4-methylbenzylidene)camphor, 4-aminobenzoic acid derivatives, preferably 4-(dimethylamino) benzoic acid 2-ethylhexyl ester, 4-(dimethylamino)benzoic acid 2-octyl ester and 4-(dimethylamino)benzoic acid amyl ester, esters of cinnamic acid, preferably 4-methoxycinnamic acid 2-ethylhexyl ester, 4-methoxycinnamic acid propyl ester, 4-methoxycinnamic acid isoamyl ester and 2-cyano-3, 3-phenylcinnamic acid 2-ethylhexyl ester (Octocrylene), esters of salicylic acid, preferably salicylic acid 2-ethylhexyl ester, salicylic acid 4-isopropylbenzyl ester and salicylic acid homomenthyl ester, derivatives of benzophenone, preferably 2-hydroxy-4-methoxybenzophenone, 2-hydroxy-4-methoxy-4'-methylbenzophenone and 2,2'-dihydroxy-4-methoxy-benzophenone, esters of benzalmalonic acid, preferably 4-methoxybenzmalonic acid di-2-ethylhexyl ester, triazine derivatives such as for example 2,4,6-trianilino-(p-carbo-2'-ethyl-1'-hexyloxy)-1,3,5-triazine and octyl triazone, or dioctyl butamido triazone (Uvasorb® HEB), propane-1,3-diones such as for example 1-4-tert-butylphenyl)-3-(4'-methoxyphenyl)propane-1,3-dione and ketotricyclo-(5.2.1.0)decane derivatives. Also suitable are 2-phenylbenzimidazole-5-sulfonic acid and alkali metal, alkaline earth metal, ammonium, alkylammonium, alkanolammonium and glucammonium salts thereof, sulfonic acid derivatives of benzophenones, preferably 2-hydroxy-4-methoxybenzophenone-5-sulfonic acid and salts thereof, sulfonic acid derivatives of 3-benzylidenecamphor, such as for example 4-(2-oxo-3-bomylidenemethyl)benzene-sulfonic acid and 2-methyl-5-(2-oxo-3-bomylidene)sulfonic acid and salts thereof.

Typical UV-A filters are in particular derivatives of benzoylmethane, such as for example 1-(4'-tert-butyl-phenyl)-3-(4'-methoxyphenyl)propane-1,3-dione, 4-tert-butyl-4'-methoxydibenzoylmethane (Parsol 1789), 1-phenyl-3-(4'-isopropylphenyl)-propane-1,3-dione and also enamine compounds. The UV-A and UV-B filters can of course also be used as mixtures. In addition to the stated soluble substances, insoluble light-protective pigments, that is finely dispersed preferably nanoized metal oxides or salts, are also possible for this. Examples of suitable metal oxides are in particular zinc oxide and titanium dioxide and also oxides of iron, zirconium, silicon, manganese, aluminum and cerium and also mixtures thereof. As salts, silicates (talc), barium sulfate or zinc stearate can be used. The oxides and salts are already used in the form of the pigments for skincare and skin protection emulsions and decorative cosmetics. The particles here should have a mean diameter of less than 100 nm, preferably between 5 and 50 nm and in particular between 15 and 30 nm. They can be spherical in shape, but particles having an ellipsoidal shape or a shape deviating in other ways from the spherical form can also be used. The pigments can also be surface-treated, i.e. hydrophobized or hydrophilized. Typical examples are coated titanium dioxides, such as for example titanium dioxide T 805 (Degussa) or Eusolex® T2000 (Merck). Possible hydrophobic coating agents here are above all silicones and specifically trialkoxyoctyl-silanes or simethicones. Preferably, micronized zinc oxide is used.

UV absorbers are typically used in amounts ranging from 0.01% by weight to 5% by weight and preferably from 0.03% by weight to 1% by weight.

The compositions of the present invention may comprise crease control agents. Since textile fabrics, especially those composed of rayon, wool, cotton and blends thereof, can tend to crease because the individual fibers are sensitive to bending, kinking, pressing and squashing transversely to the fiber direction, the compositions may comprise synthetic anti-crease agents. These include for example synthetic products based on fatty acids, fatty acid esters, fatty acid amides, fatty acid alkylolesters, fatty acid alkylolamides or fatty alcohols, which have mostly been reacted with ethylene oxide, or products based on lecithin or modified phosphoric esters.

The compositions of the present invention may comprise grayness inhibitors. Grayness inhibitors are designed to keep the soil detached from the fiber suspended in the liquor and to prevent its redeposition on the fiber. Useful grayness inhibitors include water-soluble colloids mostly organic in nature, for example glue, gelatin, salts of ether sulfonic acids of starch or of cellulose or salts of acidic sulfuric esters of cellulose or of starch. Similarly, water-soluble polyamides which comprise acidic groups are suitable for this purpose. It is also possible to use soluble starch preparations and starch products other than those mentioned above, for example degraded starch, aldehyde starches, etc. Polyvinylpyrrolidone can be used as well. However, preference is given to cellulose ethers such as carboxymethylcellulose (sodium salt), methylcellulose, hydroxyalkylcellulose and mixed ethers such as methylhydroxyethylcellulose, methylhydroxypropylcellulose, methylcarboxymethylcellulose.

The liquid laundry detergent compositions of the present invention may further comprise dye transfer inhibitors. For example, the compositions of the present invention may comprise from 0.1% by weight to 2% by weight, which may comprise a polymer of vinylpyrrolidone, vinylimidazole, vinylpyridine N-oxide or a copolymer of these. Useful dye transfer inhibitors include not only the polyvinylpyrrolidones of molecular weights in the range from 15 000 to 50 000 but also the polyvinylpyrrolidones having molar weights above 1 000 000, especially from 1 500 000 to 4 000 000, the N-vinylimidazole-N-vinylpyrrolidone copolymers, the polyvinyloxazolidones, the copolymers based on vinyl monomers and carboxamides, the polyesters and polyamides containing pyrrolidone groups, the grafted polyamidoamines and polyethyleneimines, the polymers with amide groups from secondary amines, the polyamine N-oxide polymers, the polyvinyl alcohols, and the copolymers based on acrylamidoalkenylsulfonic acids. However, it is also possible to use enzymatic systems, comprising a peroxidase and hydrogen peroxide or a substance, which in water provides hydrogen peroxide. The addition of a mediator compound for the peroxidase, for example, an acetosyringone, a phenol derivative, or a phenothiazine or phenoxazine, is preferred in this case, it being also possible to use abovementioned active polymeric dye transfer inhibitor substances as well. Polyvinylpyrrolidone for use in compositions of the invention preferably has an average molar mass in the range from 10 000 to 60 000, in particular in the range from 25 000 to 50 000. Among the copolymers, preference is given to those of vinylpyrrolidone and vinylimidazole in a molar ratio of 5:1 to 1:1 having an average molar mass in the range from 5000 to 50 000, in particular from 10 000 to 20 000.

It may also be useful to include foam inhibitors into the liquid laundry compositions according to the present invention. Suitable foam inhibitors that can be used in the products according to the invention are, for example, soaps, paraffins or silicone oils, which may optionally be applied to carrier materials. Suitable anti-redeposition agents, which are also referred to as soil repellants, are, for example, nonionic cellulose ethers, such as methylcellulose and methylhydroxypropylcellulose with a content of methoxy groups of from 15 to 30% by weight and of hydroxypropyl groups of from 1 to 15% by weight, in each case based on the nonionic cellulose ethers, and the polymers, known from the prior art, of phthalic acid and/or terephthalic acid or derivatives thereof, in particular polymers of ethylene terephthalates and/or polyethylene glycol terephthalates or anionically and/or nonionically modified derivatives of these. Of these, particular preference is given to the sulfonated derivatives of phthalic acid and terephthalic acid polymers.

To control microorganisms, the products according to the invention can comprise antimicrobial active ingredients. Useful antimicrobial agents include but are not limited to benzalkonium chlorides, alkylarylsulfonates, halophenols, phenol mecuriacetate, methylchloroisothiazolinone and methylisothiazolinone.

As well as the aforementioned components, the present invention's liquid laundry detergent compositions may comprise pearl luster agents. Pearl luster agents endow textiles with an additional luster.

TABLE 1

| Ingredients | Formulas (wt. %) 1 | 2 | 3 |
|---|---|---|---|
| AO, 45-7 | 4.00 | 3.50 | 2.80 |
| AES, 23-2s | 2.50 | 2.50 | — |
| AES, 45-7s | — | — | 2.50 |
| NaDDBS | — | — | 1.20 |
| Quaternary fatty amine ethoxylate (QFAE) | 1.00 | 0.50 | 0.50 |
| Silicone copolyol carboxylate | 0.10 | — | — |
| Tetrasodium EDTA | 0.06 | 0.05 | 0.05 |
| Dye | 0.0012 | 0.0012 | 0.0014 |
| Fluorescent whitener | 0.02 | 0.015 | 0.015 |
| Fragrance | 0.25 | 0.25 | 0.25 |
| Preservative | 0.05 | 0.05 | 0.05 |
| Sodium Chloride (viscosity modifier) | 3.25 | 3.28 | 3.50 |
| Opacifier | 0.02 | 0.02 | 0.022 |
| Water | balance | balance | balance |

TABLE 2 compares the 140F storage stability of various formulas. The remaining ingredients of each composition are the same as the formulas in TABLE 1, and have been removed to allow clarity in comparing only the differences in stability for various surfactant and softener ingredients and ratios:

TABLE 2

| Ingredients | Formulas (wt. %) 1 | 2 | 3 | 4 | 5 | 6 | 7 | 8 | 9 | 10 | 11 | 12 |
|---|---|---|---|---|---|---|---|---|---|---|---|---|
| AO, 45-7 | 4.0 | 3.5 | 2.8 | 3.2 | 4.8 | 4.8 | 4.5 | 7.0 | 6.0 | 4.5 | 4.1 | 4.5 |
| AES, 23-2s | 2.5 | 2.5 | | 2 | 2 | 2 | 2 | | | | | |
| AES, 45-7s | | | 2.5 | | | | | | | 2.2 | 2.6 | 3 |
| NaDDBS | | | 1.2 | | | | | | | | | |
| QFAE | 1.0 | 0.5 | 0.5 | 0.8 | 1.2 | 0.8 | 1.0 | 1.0 | 0.5 | 0.3 | 0.3 | 0.2 |
| Remaining ingredients | q.s. | q.s. | q.s. | q.s. | q.s. | q.s. | q.s. | q.s. | q.s. | q.s. | q.s. | q.s. |
| Stability at 140° F. | yes | yes | yes | no | no | no | no | No | no | no | no | no |

Abbreviations used in both TABLE 1 and TABLE 2:
AO, 45-7: Alcohol ethoxylate, average $C_{14}$-$C_{15}$/7-EO
AES, 23-2s: Sodium alkyl ether sulfate, average $C_{12}$-$C_{13}$/2-EO
AES, 45-7s: Sodium alkyl ether sulfate, average $C_{14}$-$C_{15}$/7-EO
NaDDBS: Sodium Dodecylbenzenesulfonate
QFAE: Ethyl bis (polyhydroxyethyl) tallowyl ammonium ethyl sulfate, such as Adogen 66 from Degussa.
"Remaining ingredients" shown in TABLE 2 are per TABLE 1.

Useful pearl luster agents include for example: alkylene glycol esters; fatty acid alkanolamides; partial glycerides; esters of polybasic carboxylic acids with or without hydroxyl substitution with fatty alcohols having 6 to 22 carbon atoms; fatty materials, for example fatty alcohols, fatty ketones, fatty aldehydes, fatty ethers and fatty carbonates which together have at least 24 carbon atoms; ring-opening products of olefin epoxides having 12 to 22 carbon atoms with fatty alcohols having 12 to 22 carbon atoms, fatty acids and/or polyols having 2 to 15 carbon atoms and 2 to 10 hydroxyl groups and also mixtures thereof.

The inclusion of a silicone copolyol carboxylate helps softening by complexing with the cationic fabric-softening compound and providing silky & slick hand feeling. The complex also helps aid the solubility and delivery of the cationic fabric-softening compounds from solution to substrate. This product is available from Lambent Technologies under the trademark Lambent Syngard CPI.

Liquid detergent compositions showing excellent soil removal properties and fabric softening and antistatic properties were prepared according to the following formulas in TABLE 1:

TABLE 3 below summarizes the performance of one of the compositions of the present invention (Formula 1 shown above in TABLE 1) versus a conventional laundry detergent formulation not having a quaternary fabric softener ingredient, with water as a reference. A Paar rheometer was used to measure the softening performance for the compositions. In this test, shear stress measurement functions as an indicator of surface lubricity. The method provides relative comparison of resistance encountered by an object when moved over the fabric surface. Lower stress (higher lubricity) is typically associated with the presence of cationic material such as a fabric softener. TABLE 3 shows that formula 1 softens fabric to a greater degree than conventional laundry detergent without fabric softener and better than simply water.

TABLE 3

| Composition Tested | Shear Stress (Pa) |
|---|---|
| Water (reference) | 575 |
| Conventional Detergent | 575 |
| Formula 1 | 544 |

Panel grading evaluation performed by an authorized independent performance lab obtained similar softening results, as shown in TABLE 4. For each product evaluated, a bundle of towels were washed five times in the AATCC detergent to strip out any softener from the manufacturer. The bundles were then washed with the test product and the washed bundles evaluated by a panel of five judges to evaluate softness on a five-point scale (5: very soft; 4: soft; 3: slightly soft; 2: slightly harsh; 1: harsh). Half point ratings are acceptable in the test.

TABLE 4

| Samples | Softness Score |
|---|---|
| Water | 3.1 |
| Conventional Detergent | 3.2 |
| Formula 1 | 3.6 |

We claim:

1. An aqueous liquid laundry composition to both clean and condition fabric comprising:

a. from about 1.5% to about 8% by weight of a nonionic surfactant comprising an alcohol ethoxylate having an alkyl chain length of from about 10 to about 18 carbon atoms and having a degree of ethoxylation of about 7 ethylene oxide moieties;

b. from about 0.5% to about 5% by weight of an anionic surfactant comprising an alkyl ether sulfate having an alkyl chain length of from about 12 to about 18 carbon atoms and having a degree of ethoxylation of about 7 ethylene oxide moieties;

c. from 0 to about 3% by weight of another anionic surfactant selected from the group consisting of alcohol sulfates having the formula R—O—$SO_3$Na wherein R is from about 11 to about 18 carbon atoms, $C_{10}$-$C_{20}$ oxo alcohols, and alkyl benzene sulfonates having an alkyl chain of from about 8 to about 16;

d. from about 0.1% to about 5% of a quaternary ammonium fabric-softening agent having the general formula (I),

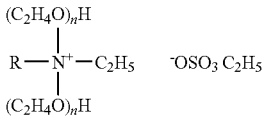

wherein R is an alkyl chain having from about 8 to about 30 carbon atoms and n is from about 1 to about 20;

e. from 0.1 to about 2% by weight of a silicone copolyol carboxylate which will complex with the quaternary softening agent for enhanced performance and compatibility.

2. The composition of claim 1, wherein said alcohol ethoxyate has an alkyl chain length of from about 14 to about 15.

3. The composition of claim 1, wherein said alkyl ether sulfate has an alkyl chain length of from about 14 to about 15.

4. The composition of claim 1, wherein said quaternary ammonium fabric-softening agent is ethyl bis-(-polyethoxy ethanol) tallow ammonium ethosulfate.

5. The composition of claim 4 further comprising from about 1% to about 3% by weight of said another anionic surfactant.

6. The composition of claim 5, wherein said another anionic surfactant is an alcohol sulfate having the formula R—O—$SO_3$Na, wherein R is from about 11 to about 18 carbon atoms.

7. The composition of claim 5, wherein said another anionic surfactant is an alkyl benzene sulfonate having an alkyl chain of from about 8 to about 16 carbon atoms.

8. The composition of claim 7, wherein said alkyl benzene sulfonate is sodium dodecylbenzene sulfonate.

9. The composition of claim 1 comprising from about 2% to about 5% of said alcohol ethoxylate having an alkyl chain length from about 14 to about 15 carbon atoms and a degree of ethoxylation of about 7, about 1% to about 4% of said alkyl ether sulfate having an alkyl chain length from about 12 to about 15 carbon atoms and a degree of ethoxylation of about 7, about 0.5% to about 2% of said quaternary ammonium fabric-softening agent comprising the general formula,

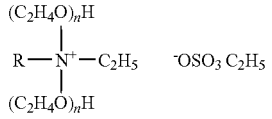

wherein R is an alkyl chain having from about 8 to about 30 carbon atoms and n is from about 1 to about 20.

10. The composition of claim 9 comprising from about 1% to about 2% of said another anionic surfactant, wherein said another anionic surfactant is sodium dodecylbenzene sulfonate.

11. The composition of claim 9 wherein said quaternary fabric-softening agent is ethyl bis-(-polyethoxy ethanol) tallow ammonium ethosulfate.

12. The composition of claim 10 wherein said quaternary fabric-softening agent is ethyl bis-(-polyethoxy ethanol) tallow ammonium ethosulfate.

* * * * *